US008011753B2

(12) United States Patent
Nakata et al.

(10) Patent No.: US 8,011,753 B2
(45) Date of Patent: Sep. 6, 2011

(54) LIQUID EJECTING APPARATUS

(75) Inventors: Satoshi Nakata, Matsumoto (JP); Hitoshi Igarashi, Shiojiri (JP); Yosuke Nakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 12/568,825

(22) Filed: Sep. 29, 2009

(65) Prior Publication Data

US 2010/0079541 A1 Apr. 1, 2010

(30) Foreign Application Priority Data

Sep. 30, 2008 (JP) ..... 2008-254258

(51) Int. Cl.
*B41J 2/165* (2006.01)

(52) U.S. Cl. ..... 347/31

(58) Field of Classification Search ..... None
See application file for complete search history.

(56) References Cited

U.S. PATENT DOCUMENTS 6,916,076 B2 * 7/2005 Yoshiyama et al. ..... 347/7

FOREIGN PATENT DOCUMENTS

| | | |
|---|---|---|
| JP | 2003-063041 | 3/2003 |
| JP | 2006-335531 | 12/2006 |
| JP | 2006-335532 | 12/2006 |

* cited by examiner

*Primary Examiner* — Matthew Luu
*Assistant Examiner* — Alejandro Valencia
(74) *Attorney, Agent, or Firm* — Workman Nydegger

(57) ABSTRACT

A liquid ejecting apparatus includes a liquid ejecting head which ejects a liquid onto a liquid ejection surface of an ejection target member; a scanning unit which scans the liquid ejecting head relative to the ejection target member; and a driving force transmission mechanism which transmits driving force of a rotary driving force source to the scanning unit through a belt, wherein a liquid absorbing material which absorbs and retains mists of a liquid floating in an inner space of the liquid ejecting apparatus is disposed on the belt.

8 Claims, 6 Drawing Sheets

LIQUID EJECTING APPARATUS

BACKGROUND

1. Technical Field

The present invention relates to a liquid ejecting apparatus which ejects a liquid onto a liquid ejection surface of an ejection target member.

Here, a liquid ejecting apparatus is not limited to an ink jet type recording apparatus, a copy machine, and a facsimile machine which eject ink onto an ejection target member such as a recording paper from a liquid ejecting head such as a recording head to perform recording for the recording paper, and is interpreted to include an apparatus which ejects a liquid, corresponding to a certain use instead of ink, onto an ejection target member from a liquid ejecting head and sticks a liquid to the ejection target member.

Examples of a liquid ejecting head include a color material ejecting head used for manufacturing a color filter of a liquid crystal display (LCD), an electrode material (conductive paste) ejecting head used for forming electrode of an organic electroluminescence (EL) display or a plane emission display (FED), a bio-organic material ejecting head used for manufacturing a biochip, and a sample ejecting head which ejects a sample as a precise pipette as well as the recording head.

2. Related Art

An ink jet printer is well known as an example of a liquid ejecting apparatus which ejects a liquid onto a liquid ejection surface of an ejection target member. For example, a serial head type ink jet printer performs recording onto a recording surface of a recording paper such that an operation of ejecting ink (a liquid) from a recording head which reciprocates in a direction crossing a transport direction of a recording paper (an ejection target member) to form a dot on a recording surface (a liquid ejection surface) of the recording paper and an operation of transporting a predetermined transport amount of recording paper in the transport direction are alternately repeatedly performed. The ink jet printer aims to control the reciprocal operation of the recording head and the transport operation for the recording paper with a high degree of accuracy and implement highly accurate recording. To this end, the ink jet printer commonly includes a linear encoder for detecting the movement amount of the recording head or a rotary encoder for detecting the transport amount of the recording paper.

In the liquid ejecting apparatus, part of the liquid ejected onto the ejection target member from the liquid ejecting head may float in the liquid ejecting apparatus in the form of mist. For example, in the ink jet printer, part of ink ejected from the recording head is changed to ink mists, and ink mists float in an inner space of the printer. The ink mists stick to the recording paper causing the recording image quality to deteriorate. Further, when ink mists stick to a scale of the linear encoder or the rotary encoder, the scale reading accuracy of a scale sensor may deteriorate. That is, ink mists which stick to the scale of the encoder cause the detection accuracy of the movement amount of the recording head or the transport amount for the recording paper to deteriorate, thereby causing the recording accuracy to deteriorate.

In order to reduce the ink mists, as one example of a related art, an ink jet printer is known in which a charging member is installed at a location adjacent to an ink ejection area in which an ink is ejected from a recording head, and the charging member is electrically charged to a polarity different from the polarity of the ink mists to thereby attract and remove ink mists generated in the ink ejection area through electrostatic force (for example, JP-A-2006-335531 and 2006-335532).

However, in the related art, the ink mists attracted to the charging member stick to a surface of the charging member only through attraction force caused by static electricity electrically charged to the charging member. Therefore, for example, due to an air current, vibration, or abrasion which is generated when a carriage reciprocally moves inside a printer, a different component or a recording paper, which is electrically charged, is attracted by static electricity, so that part of the ink mists which stick to a surface of the charging member may be separated from the charging member and fly inside the printer again. For this reason, the related art described above has a problem in that mists of a liquid which floats in the inner space of the liquid ejecting apparatus cannot be effectively reduced.

SUMMARY

An advantage of some aspects of the invention is that it provides a liquid ejecting apparatus in which mists of a liquid which float in the inner space of the liquid ejecting apparatus are effectively reduced.

According to a first aspect of the invention, there is provided a liquid ejecting apparatus including: a liquid ejecting head which ejects a liquid onto a liquid ejection surface of an ejection target member; a scanning unit which scans the liquid ejecting head relative to the ejection target member; and a driving force transmission mechanism which transmits driving force of a rotary driving force source to the scanning unit through a belt, wherein a liquid absorbing material which absorbs and retains mists of a liquid floating in an inner space of the liquid ejecting apparatus is disposed on the belt.

In the driving force transmission mechanism which transmits driving force of a rotary driving force source to a belt, static electricity is charged to the belt by contact charging or separation charging which is generated between a pulley with which the belt is engaged or a rotator and the belt. Static electricity is charged to the liquid absorbing material formed on the belt by induction charging from the charged belt. Mists of a liquid which float in the inner space of the liquid ejecting apparatus are attracted by static electricity of the charged liquid absorbing material, captured by the liquid absorbing material, and absorbed into the liquid absorbing material. Therefore, after capture through the liquid absorbing material of the belt, mists of a liquid which float in the inner space of the liquid ejecting apparatus are firmly retained in the liquid absorbing material. As described above, since mists of a liquid which float in the inner space of the liquid ejecting apparatus can be captured and retained with a high degree of certainty, it is possible to prevent mists of a liquid from flying again in advance.

According to the first aspect of the invention, the liquid ejecting apparatus has an effect of effectively reducing mists of a liquid which float in the inner space of the liquid ejecting apparatus.

According to a second aspect of the invention, the liquid ejecting apparatus of the first aspect further includes a cleaning unit for the liquid absorbing material.

The liquid absorbing performance or the liquid retaining performance of the liquid absorbing material gradually deteriorates as a liquid is accumulated in the liquid absorbing material. Therefore, a cleaning unit is preferably disposed which removes a liquid accumulated in the liquid absorbing material to restore the liquid absorbing performance or the liquid retaining performance of the liquid absorbing material. Therefore, a high liquid absorbing performance or a high liquid retaining performance of the ink absorbing material 59 can always be maintained, thereby preventing the efficiency of the removal of the mists of a liquid from deteriorating in advance.

According to a third aspect of the invention, the liquid ejecting apparatus of the first aspect or the second aspect further includes a controller which performs control for ejecting a liquid onto a liquid ejection surface of the ejection target member, wherein the controller performs control for rotating the belt by a predetermined rotation amount after finishing liquid ejecting control for the ejection target member.

The belt which transfers driving force to the scanning unit of the liquid ejecting head rotates while liquid ejecting control for the ejection target member is being performed. Therefore, at least, when liquid ejecting control for the ejection target member is performed, since a state in which static electricity equal to or more than a predetermined level is charged to the liquid absorbing material formed on the belt is maintained, the liquid absorbing material can attract and absorb mists of a liquid. When liquid ejecting control for the ejection target member is finished and the belt is stopped, static electricity charged to the liquid absorbing material is steadily discharged and reduced. On the other hand, even after liquid ejecting control for the ejection target member is finished, mists of a liquid may float in the inner space of the liquid ejecting apparatus for a while.

In order to cope with the problem, after liquid ejecting control for the ejection target member is finished, control for rotating the belt by a predetermined rotation amount is preferably performed. Therefore, even after liquid ejecting control for the ejection target member is finished, static electricity can be charged to the liquid absorbing material of the belt by a charging amount corresponding to the rotation amount. That is, after liquid ejecting control for the ejection target member is finished, a state which can attract and absorb mist of a liquid through the liquid absorbing material can be maintained for a longer time period. Even after liquid ejecting control for the ejection target member is finished, mists of a liquid which float in the inner space of the liquid ejecting apparatus can be effectively reduced.

According to a fourth aspect of the invention, there is provided a liquid ejecting apparatus including: a liquid ejecting head which ejects a liquid onto a liquid ejection surface of an ejection target member; a scanning unit which scans the liquid ejecting head relative to the ejection target member; a driving force transmission mechanism which transmits driving force of a rotary driving force source to the scanning unit through a belt; a belt cleaning unit which removes a liquid sticking to the belt; and a controller which performs control for ejecting a liquid onto a liquid ejection surface of an ejection target member, wherein the controller performs control for rotating the belt by a predetermined rotation amount after finishing liquid ejecting control for the ejection target member.

The belt which transfers driving force to the scanning unit of the liquid ejecting head rotates while liquid ejecting control for the ejection target member is being performed. Static electricity is charged to the belt by contact charging or separation charging which is generated between a pulley with which the belt is engaged or a rotator and the belt. When liquid ejecting control for the ejection target member is performed, since a state in which static electricity equal to or more than a predetermined level is charged to the belt is maintained, mists of a liquid can be absorbed into the belt and collected by the belt cleaning unit. However, when liquid ejecting control for the ejection target member is finished and the belt is stopped, static electricity charged to the belt is steadily discharged and reduced. On the other hand, even after liquid ejecting control for the ejection target member is finished, mists of a liquid may float in the inner space of the liquid ejecting apparatus for a while.

In the liquid ejecting apparatus according to the fourth aspect of the invention, the controller performs control for rotating the belt by a predetermined rotation amount after liquid ejecting control for the ejection target member is finished. Therefore, after liquid ejecting control for the ejection target member is finished, static electricity can be charged to the belt by a charging amount corresponding to the rotation amount. That is, after liquid ejecting control for the ejection target member is finished, a state which can absorb mists of a liquid into the belt and collect the mists of a liquid through the belt cleaning unit can be maintained for a longer time period. The liquid ejecting apparatus according to the fourth aspect of the invention has an effect of effectively reducing mists of a liquid which float in the inner space of the liquid ejecting apparatus even after liquid ejecting control for the ejection target member is finished.

According to a fifth aspect of the invention, in the liquid ejecting apparatus of the third aspect or the fourth aspect, the controller increases or decreases the predetermined rotation amount based on a liquid ejecting control mode for the ejection target member.

The amount of mists of a liquid which float in the inner space of the liquid ejecting apparatus increases as the total ejection amount of a liquid ejected onto one ejection target member increases. As the size of a liquid dot formed on the liquid ejection surface of the ejection target member decreases, the liquid ejected from the liquid ejecting head is more easily changed to mist. Therefore, the amount of mists of a liquid increases as the size of a liquid dot formed on the liquid ejection surface of the ejection target member decreases even though the total ejection amount of a liquid ejected onto the one ejection target member is the same. That is, the amount of mists of a liquid which float after liquid ejecting control for the ejection target member is finished depends on a liquid ejecting control content for the ejection target member and can be estimated from the liquid ejecting control content.

The liquid ejecting control content for the ejection target member such as the resolution and the size of liquid drops to be ejected is set by selecting one mode from among a plurality of modes in which the contents are previously specified. The mode is arbitrarily or automatically selected according to a user depending on the type or the size of the ejection target member or whether or not a margin is set in four sides of the ejection target member. Therefore, the amount of mists of a liquid which float after liquid ejecting control for the ejection target member is finished can be specified by the liquid ejecting control mode.

According to an embodiment of the invention, it is preferable that the predetermined rotation amount increases or decreases based on the liquid ejecting control mode for the ejection target member. Therefore, the charging amount of the belt or the liquid absorbing material after liquid ejecting control is finished can be adjusted according to the amount of mists of a liquid which float while liquid ejecting control for the ejection target member is being performed. That is, the time of continuing a state which can attract and collect mists of a liquid through the belt or the liquid absorbing material after liquid ejecting control is finished can be accurately adjusted according to the amount of mists of a liquid during liquid ejecting control. Therefore, mists of a liquid which float in the inner space of the liquid ejecting apparatus can be effectively reduced even after liquid ejecting control for the ejection target member is finished, and abrasion or power consumption caused by rotation of the belt can be minimized.

According to a sixth aspect of the invention, in the liquid ejecting apparatus of the third aspect or the fourth aspect, the controller sets the rotation speed of the belt when control for rotating the belt by the predetermined rotation amount is performed based on a liquid ejecting control mode for the ejection target member.

When control for rotating the belt by a predetermined rotation amount is performed after liquid ejecting control is finished, the rotation speed of the belt may be adjusted to adjust a charging amount of the belt or the liquid absorbing material after liquid ejecting control is finished. This aspect can have the same effect as the fifth aspect.

According to a seventh aspect of the invention, in the liquid ejecting apparatus of one of the third to sixth aspects, when a power OFF operation of the liquid ejecting apparatus is detected, the controller performs power OFF control of the liquid ejecting apparatus after finishing control for rotating the belt by the predetermined rotation amount.

According to this feature, since static electricity is continuously charged to the belt or the liquid absorbing material during a predetermined time period even after power of the liquid ejecting apparatus is off, a state which can attract and collect mists of a liquid through the belt or the liquid absorbing material can be maintained during a predetermined time period even after the power of the liquid ejecting apparatus is turned off. Therefore, mists of a liquid which float in the inner space of the liquid ejecting apparatus can be effectively reduced even after the power of the liquid ejecting apparatus is turned off.

According to an eighth aspect of the invention, in the liquid ejecting apparatus of the seventh aspect, when a power OFF operation of the liquid ejecting apparatus is detected, the controller performs control for rotating the belt at a rotation amount greater than a rotation amount or at a rotation speed higher than a rotation speed when control for rotating the belt is performed after the latest liquid ejecting control for an ejection target member is finished.

According to this feature, since the time a liquid mist removal effect is maintained after the power of the liquid ejecting apparatus is turned off can be increased, mists of a liquid which float in the inner space of the liquid ejecting apparatus after power OFF can be further effectively reduced. A floating amount of mists of a liquid at the time of detecting a power OFF operation of the liquid ejecting apparatus can be estimated as accurately as possible based on a rotation amount or a rotation speed corresponding to the latest liquid ejecting control for the ejection target member. Therefore, the time a liquid mist removal effect is maintained after the power of the liquid ejecting apparatus is turned off can be accurately set according to a floating amount of mists of a liquid at that time.

According to a ninth aspect of the invention, in the liquid ejecting apparatus of the seventh aspect or the eighth aspect, when a power OFF operation of the liquid ejecting apparatus is detected, if a predetermined time elapses after latest liquid ejecting control for an ejection target member is finished, the controller does not perform control for rotating the belt and performs a power OFF control of the liquid ejecting apparatus.

During or immediately after liquid ejecting control for the ejection target member is when the largest amount of mists of a liquid float in the inner space of the liquid ejecting apparatus. As time elapses, the liquid calms down to reduce the amount of mists of a liquid. When a predetermined time period elapses after liquid ejecting control is finished, a small amount of mists of a liquid float in the inner space of the liquid ejecting apparatus. According to an embodiment of the invention, when a power OFF operation is detected, if a predetermined time period elapses after liquid ejecting control is finished, control of rotating the belt is not performed, and power OFF control of the liquid ejecting apparatus is preferably performed. Therefore, unnecessary abrasion of the belt or power consumption can be avoided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

Schematic Configuration of an Ink Jet Printer

First, an ink jet printer 50 as a "liquid ejecting apparatus" according to the invention will be described with reference to FIGS. 1 and 2.

Figure 1:
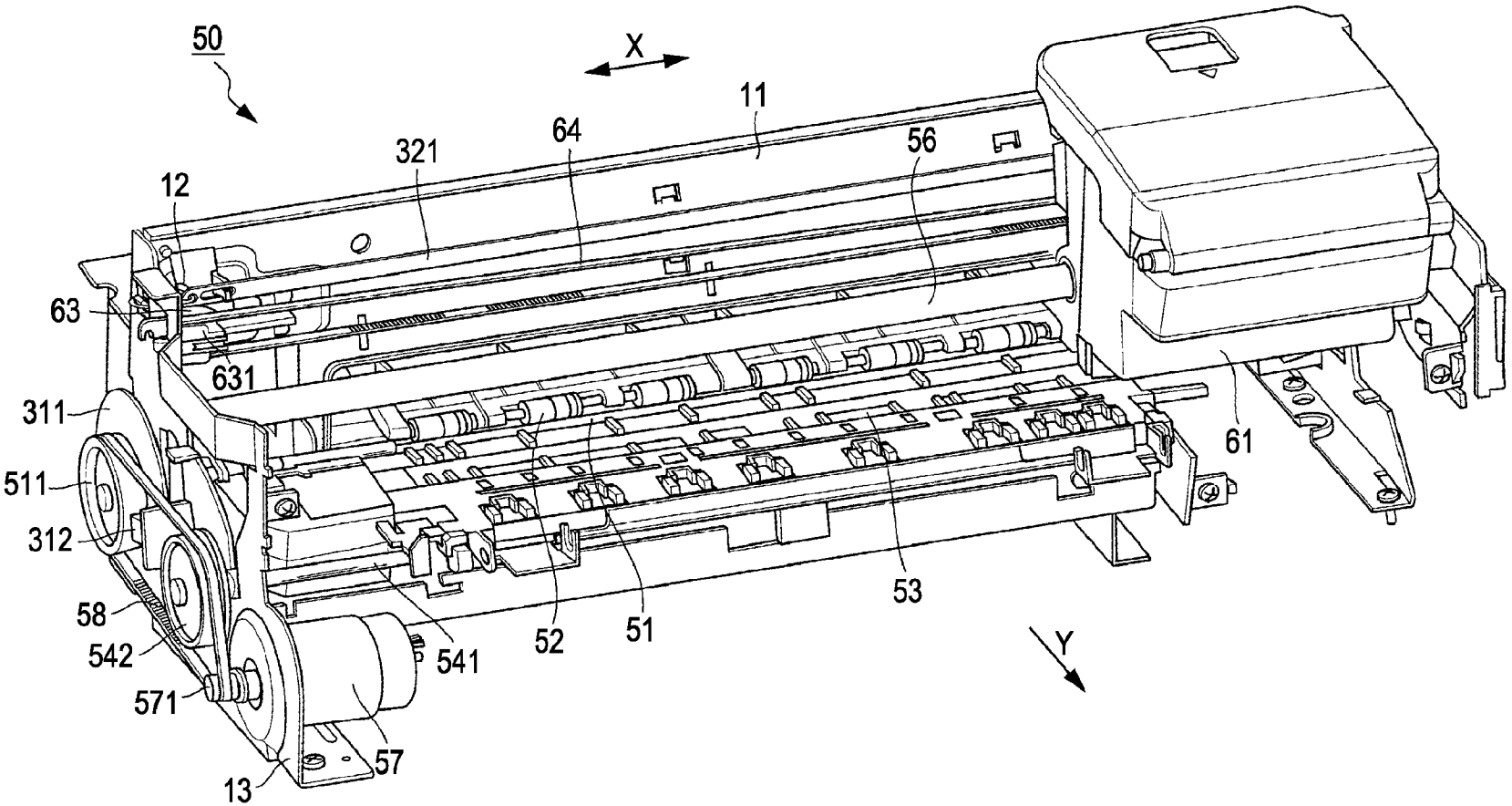
FIG. 1 is a main part perspective view of an ink jet printer.
Figure 2:
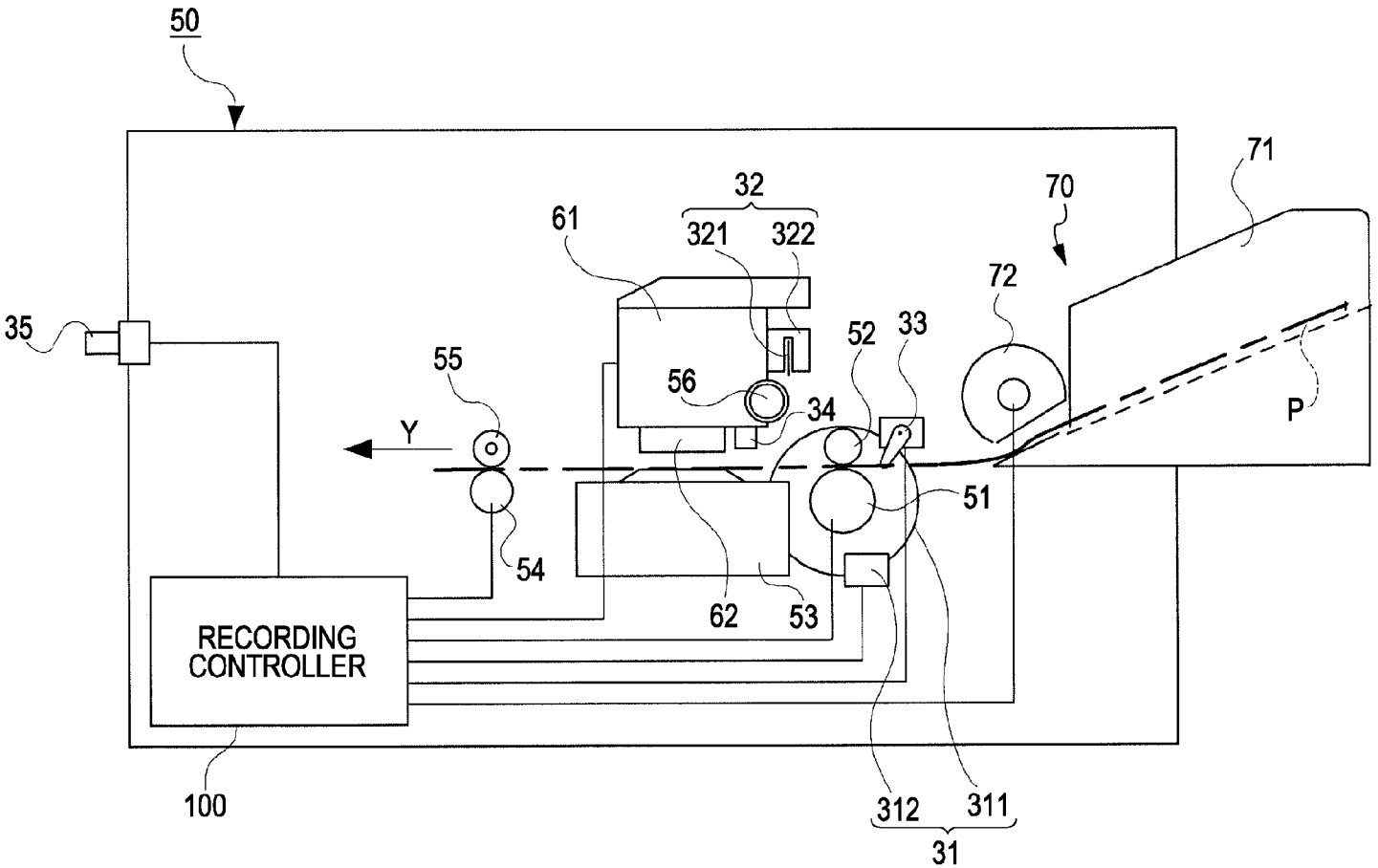
FIG. 2 is a main part side view of an ink jet printer.

FIG. 1 is a main part perspective view illustrating an ink jet printer 50, and FIG. 2 is a main part side view illustrating the ink jet printer 50.

The ink jet printer 50 according to the invention includes an automatic feeding apparatus 70 for feeding a recording paper P as an "ejection target member" into the ink jet printer 50. The ink jet printer 50 includes a recording head 62 as a "liquid ejecting head" which ejects ink as a "liquid" onto a recording surface (a liquid ejection surface) of the recording paper P supported by a platen 53 and performs recording. The ink jet printer 50 includes a transport driving roller 51, a transport driven roller 52, a discharge driving roller 54, and a discharge driven roller 55 which configure a "scanning unit" which scans the recording head 62 relative to the recording paper P in a sub-scanning direction Y.

The automatic feeding apparatus 70 includes a feeding tray 71 and a feeding roller 72. The feeding tray 71 is mounted and accommodated in a state in which a plurality of recording papers P is stacked. The feeding roller 72 is rotated by the rotary driving force of a feeding motor which is not illustrated in the drawings. In the recording papers P stacked on the feeding tray 71, the recording paper P at the highest position contacts an outer peripheral surface of the feeding roller 72 and is fed to a location in which a front end thereof arrives at a part which the transport driving roller 51 and the transport driven roller 52 contact, by rotation of the feeding roller 72.

The transport driving roller 51 has a high friction coating film installed on a surface thereof and is supplied with rotary driving force of the transport motor 57 in order to rotate. The transport driven roller 52 is journaled so as to be rotatably driven and comes in contact with an outer peripheral surface of the transport driving roller 51 due to the urging force of an urging means such as a spring which is not illustrated in the drawings. The recording paper P fed by the automatic feeding apparatus 70 is sandwiched between the transport driving roller 51 and the transport driven roller 52 and transported in the sub-scanning direction Y on the platen 53 by the driving rotation of the transport driving roller 51.

The recording head 62 is disposed at the bottom of the carriage 61 as a "scanning means" which scans the recording head 62 in a main-scanning direction X (a direction crossing the sub-scanning direction Y) relative to the recording paper P on the platen 53. A plurality of ejecting nozzles for ejecting ink is disposed on a head surface of the recording head 62. The carriage 61 is supported by a carriage guide shaft 56 to be able to reciprocate in the main-scanning direction X while maintaining a state in which the head surface of the recording head 62 and the recording surface of the recording paper P on the platen 53 are approximately parallel to each other.

On a feeding path between the feeding roller 72 and the transport driving roller 51, a paper detector 33 which detects the front end position and the rear end position of the recording paper P in the sub-scanning direction Y is disposed. A PW sensor 34 which detects both end positions of the recording paper P in the main-scanning direction X is disposed at a bottom of the carriage 61. A power switch 35 is a switch for performing a power ON/OFF operation of the ink jet printer 50. Output signals of the paper detector 33, the PW sensor 34, and the power switch 35 are input to a recording controller 100.

Recording for the recording paper P on the platen 53 is performed such that an operation in which the carriage 61 reciprocates in the main-scanning direction X and ink is ejected from the head surface of the recording head 62 onto the recording surface to form a dot and an operation in which a predetermined amount of the recording papers P are transported in the sub-scanning direction Y by the driving rotation of the transport driving roller 51 are alternately repeatedly performed. After ink is ejected, the recording paper P is sandwiched between the discharge driving roller 54 and the discharging driven roller 55, and fed and discharged in the sub-scanning direction Y by the driving rotation of the discharge driving roller 54. Such recording control is performed by the recording controller 100 as a "controller" having a microcomputer control circuit.

Driving Mechanism of the Carriage 61

Next, a mechanism which reciprocates the carriage 61 in the main-scanning direction X will be described with reference to FIGS. 1 and 2.

A carriage belt 64 is engaged between a driving pulley (not illustrated) and a driven pulley 63 which are disposed on a rotation shaft of a carriage driving motor (not illustrated). The carriage belt 64 is an endless belt made of, for example, urethane. A part of the carriage belt 64 is connected to the carriage 61. The driven pulley 63 is rotatably journaled through a driven pulley holder 631. The carriage 61 reciprocates in the main-scanning direction X when the carriage driving motor rotates so that the carriage belt 64 rotates in both directions (a driving force transmission mechanism).

The ink jet printer 50 includes a linear encoder 32 which detects a main-scanning position of the recording head 62 relative to the recording paper P. The linear encoder 32 includes a linear scale 321 and a linear scale sensor 322. The linear scale 321 is a scale member of a tape form and has a plurality of slits which are formed at a predetermined regular interval. The linear scale 321 is disposed approximately parallel to a reciprocating direction (the main-scanning direction X) of the carriage 61 at a position adjacent to the carriage belt 64 as illustrated in FIG. 1. The linear scale 321 is mounted between side frames 13 of a case frame 11 of the ink jet printer 50 through a coil spring 12. The linear scale sensor 322 is a sensor which can detect a slit of the linear scale 321 and which is mounted on the carriage 61. An output signal of the linear scale sensor 322 is input to the recording controller 100.

Driving Mechanism of the Transport Driving Roller 51 and the Discharge Driving Roller 54

Next, a mechanism which rotates the transport driving roller 51 and the discharge driving roller 54 to transport the recording paper P in the sub-scanning direction Y will be described below with reference to FIGS. 1 and 2.

A gear wheel 511 is disposed on an end of the transport driving roller 51. A gear wheel 542 is disposed on an end of the rotation shaft 541 of the discharge driving roller 54. A paper transport belt 58 is engaged with a driving pulley 571 of the transport motor 57, the gear wheel 511 and the gear wheel 542. The paper transport belt 58 is an endless belt made of, for example, urethane. Rotary driving force of the transport motor 57 is transferred to the gear wheel 511 and the gear wheel 542 through the paper transport belt 58, so that the transport driving roller 51 and the discharge driving roller 54 rotate.

The ink jet printer 50 includes a rotary encoder 31 which detects a sub-scanning position of the recording head 62 relative to the recording paper P. The rotary encoder 31 includes a rotary scale 311 and a rotary scale sensor 312. The rotary scale 311 is a scale member of a disk form and has a plurality of slits which are formed on a concentric circle at a regular interval. The rotary scale 311 is installed to be integrated with the gear wheel 511 and disposed at a location adjacent to the paper transport belt 58 as illustrated in FIG. 1. The rotary scale sensor 312 is a sensor which can detect a slit of the rotary scale 311 and which is disposed at a location adjacent to the rotary scale 311. An output signal of the rotary scale sensor 312 is input to the recording controller 100.

First Embodiment

A first embodiment of the invention will be described with reference to FIG. 3.

Figure 3:
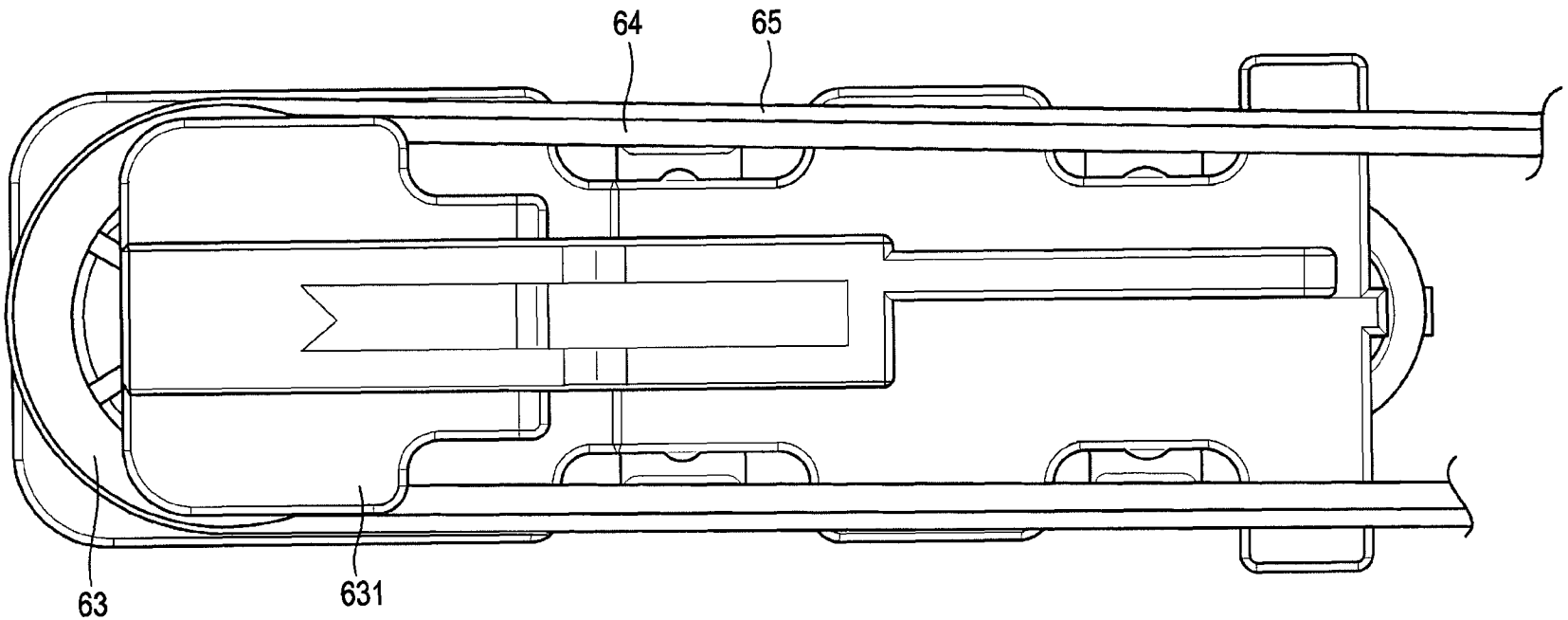
FIG. 3 is a plane view illustrating an enlarged part of a carriage belt (a first embodiment).

FIG. 3 illustrates the first embodiment of the invention and is a plane view illustrating an enlarged part of the carriage belt 64.

In the ink jet printer 50 according to the first embodiment of the invention, an ink absorbing material 65 is disposed on an outer peripheral surface of the carriage belt 64. The ink absorbing material 65 absorbs and retains ink mists which float in an inner space of the ink jet printer 50 (a liquid absorbing material). The ink absorbing material 65 may be made of, for example, felt, or urethane sponge. The ink absorbing material 65 may be disposed on a part of the outer peripheral surface of the carriage belt 64, but in order to collect ink mists more effectively, the ink absorbing material 65 is preferably disposed over the whole periphery of the carriage belt 64.

As the carriage belt 64 rotates in both directions, the carriage 61 reciprocates in the main-scanning direction X. At this time, static electricity is charged to the carriage belt 64 by contact charging or separation charging which is generated at a location in which the carriage belt 64 comes in contact with or is separated from the driven pulley 63. Static electricity is charged to the ink absorbing material 65 disposed on the carriage belt 64 by induction charging from the charged carriage belt 64. Ink mists which float in the inner space of the ink jet printer 50 are attracted by static electricity of the charged ink absorbing material 65 and captured by the ink absorbing material 65. Therefore, ink mists which float in the inner space of the ink jet printer 50 can be reduced.

Further, ink mists captured by the ink absorbing material 65 are absorbed into the ink absorbing material 65 "as is" and thus securely retained within the ink absorbing material 65. As a result, a problem in that part of ink mists captured by the ink absorbing material 65 returns to the inner space of the ink jet printer 50 can be inhibited in advance. Therefore, according to the present embodiment, ink mists which float in the inner space of the ink jet printer 50 can be effectively reduced.

Second Embodiment

A second embodiment of the invention will be described with reference to FIG. 4.

Figure 4:
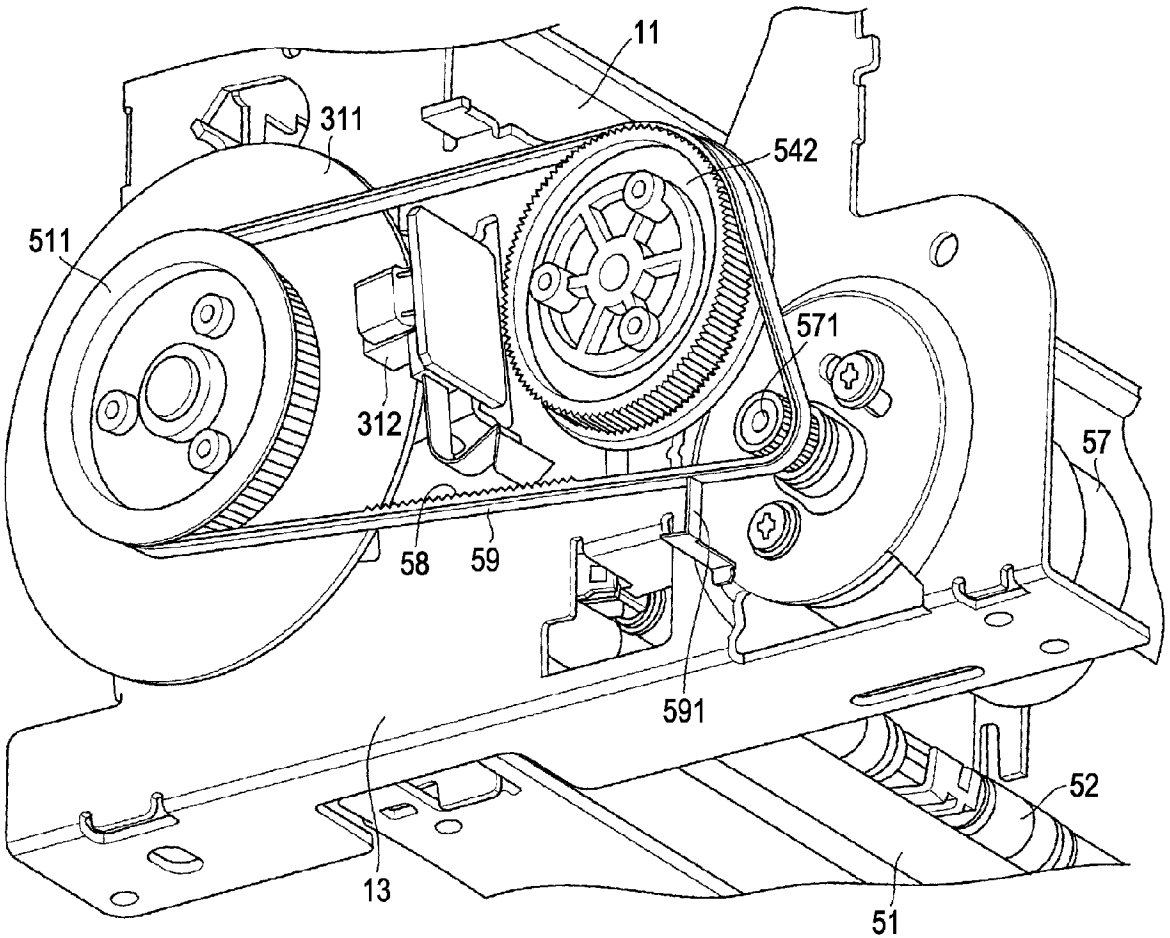
FIG. 4 is a perspective view illustrating a part in which a paper transport belt is disposed (a second embodiment).

FIG. 4 illustrates the second embodiment of the invention and is a perspective view illustrating a part in which the paper transport belt 58 is disposed.

In the ink jet printer 50 according to the second embodiment of the invention, an ink absorbing material 59 is disposed on an outer peripheral surface of the paper transport belt 58 which transfers driving force to the transport driving roller 51 and the discharge driving roller 54. The ink absorbing material 59 absorbs and retains ink mists which float in an inner space of the ink jet printer 50 (a liquid absorbing material). The ink absorbing material 59 may be made of the same material as the ink absorbing material 65 of the first embodiment such as felt, or urethane sponge.

As the paper transport belt 58 rotates, the transport driving roller 51 and the discharge driving roller 54 rotate. At this time, static electricity is charged to the paper transport belt 58 by contact charging or separation charging which is mainly generated at a location in which the paper transport belt 58 comes in contact with or is separated from the gear wheel 511 or the gear wheel 542. Static electricity is charged to the ink absorbing material 59 disposed on the paper transport belt 58 by induction charging from the charged paper transport belt 58. Ink mists which float in the inner space of the ink jet printer 50 are attracted by static electricity of the charged ink absorbing material 59 and captured by the ink absorbing material 59. Therefore, ink mists which float in the inner space of the ink jet printer 50 can be reduced.

Further, ink mists captured by the ink absorbing material 59 are absorbed into the ink absorbing material 59 "as is" and are thus securely retained within the ink absorbing material 59. As a result, a problem in that part of ink mists captured by the ink absorbing material 59 returns to the inner space of the ink jet printer 50 can be inhibited in advance. Therefore, according to the present embodiment, ink mists which float in the inner space of the ink jet printer 50 can be effectively reduced.

Further, in the present embodiment, a "cleaning unit" which removes ink accumulated in the ink absorbing material 59 to restore the ink absorbing performance or the ink retaining performance of the ink absorbing material 59 is preferably optionally disposed. In further detail, for example, an ink removal member 591 which slides to contact and engage with the ink absorbing material 59 of the paper transport belt 58 may be provided to scrape and remove solidified ink retained within the ink absorbing material 59 (FIG. 4). As a result, the high ink absorbing performance or the high ink retaining performance of the ink absorbing material 59 can always be maintained, thereby preventing the ink mist removal efficiency of the ink absorbing material 59 from deteriorating in advance.

Third Embodiment

In a third embodiment, in the ink jet printer 50 in which the first embodiment and the second embodiment are combined, after finishing recording control for the recording paper P, the recording controller 100 performs control of rotating the paper transport belt 58 and the carriage belt 64 by a predetermined rotation amount at a predetermined speed. This control aims to effectively remove ink mists which still float in the inner space of the ink jet printer 50 even after performing recording control for the recording paper P. The third embodiment will be described with reference to a flowchart illustrated in FIGS. 5A and 5B.

Figure 5A:
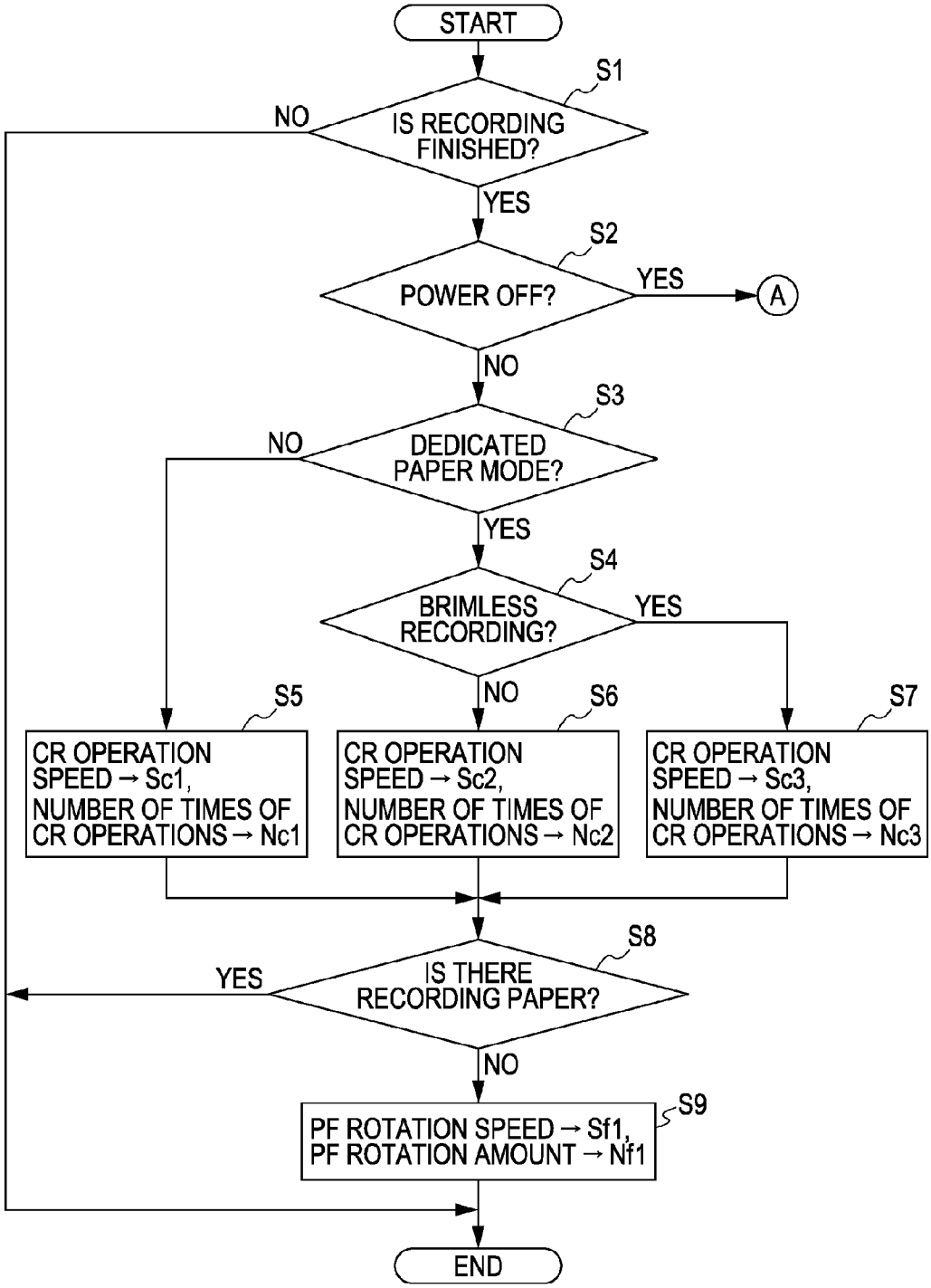
FIG. 5A is a flowchart illustrating control performed after recording control is finished (a third embodiment).
Figure 5B:
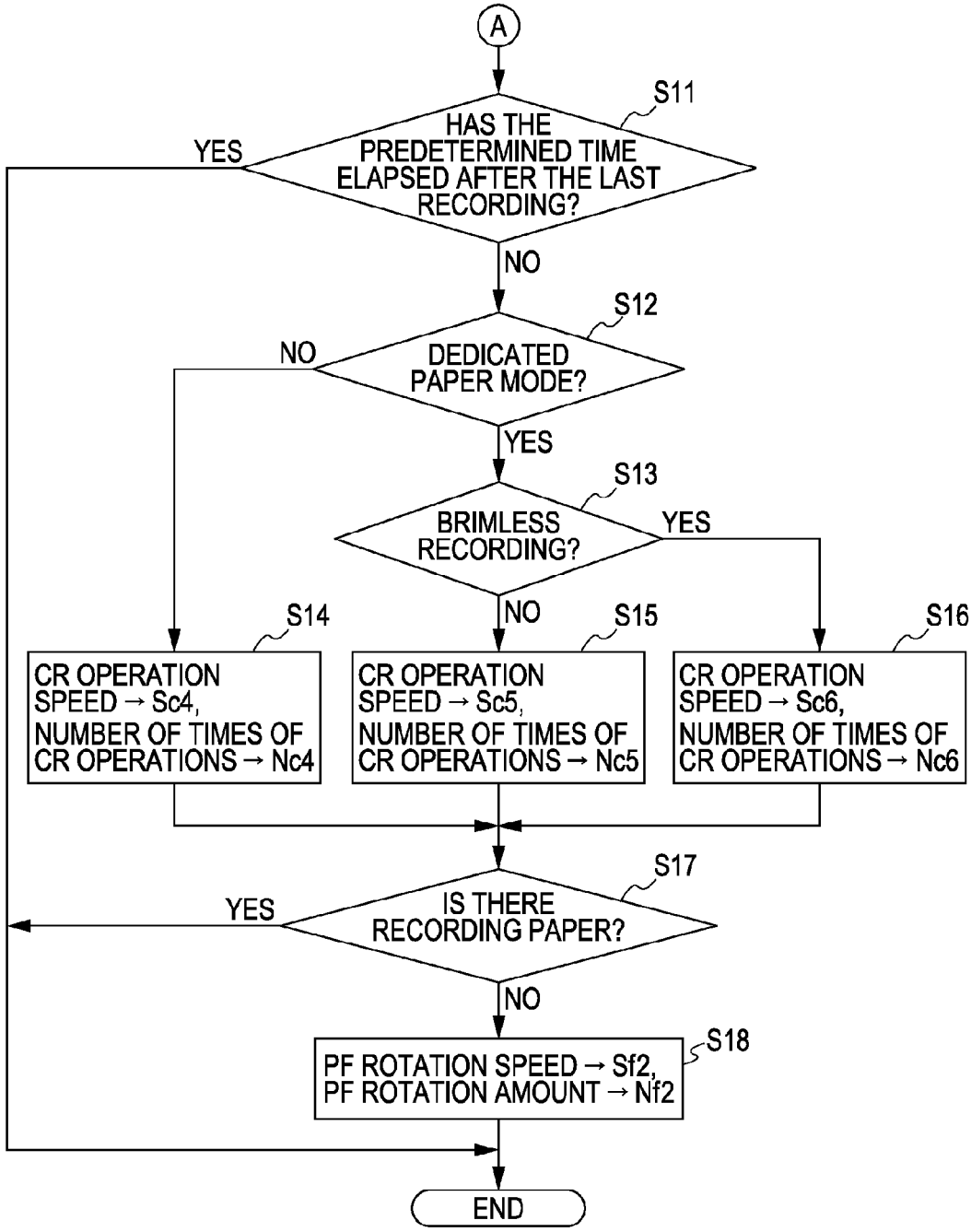
FIG. 5B is a flowchart illustrating control performed after recording control is finished (a third embodiment).

FIGS. 5A and 5B are flowcharts illustrating control performed after finishing recording control for the recording paper P.

First, it is determined whether or not recording control for the recording paper P is finished (step S1). When it is determined that recording control for the recording paper P is not finished yet (No in step S1), the procedure is finished. However, when it is determined that recording control for the recording paper P is being finished, after recording is finished, it is determined whether or not a power OFF operation of the ink jet printer 50 by a user is performed (step S2).

When it is determined that a power OFF operation is not performed (No in step S2), it is determined whether or not the recording mode at the time of performing the latest recording control for the recording paper P is a dedicated paper mode (step S3). When it is determined that the recording mode is not the dedicated paper mode (No in step S3), the recording mode is determined to be a plain paper mode, so that the carriage 61 reciprocates by the number of times of operations Nc1 at an operation speed Sc1 (step S5). However, when it is determined that the recording mode is a dedicated paper mode (Yes in step S3), it is determined whether or not latest recording control for the recording paper P is for brimless recording (step S4). When it is determined that the latest recording control is not for brimless recording (No in step S4), the carriage 61 reciprocates by the number of times of operations Nc2 at an operation speed Sc2 (step S6). When it is determined that the latest recording control is for brimless recording (Yes in step S4), the carriage 61 reciprocates by the number of times of operations Nc3 at an operation speed Sc3 (step S7).

After a reciprocation operation of the carriage 61 is performed (step S5, S6 or S7), it is determined whether or not there is any recording paper P remaining inside the ink jet printer 50 due to, for example, a paper jam (step S8). When it is determined that the remaining recording paper P is present (Yes in step S8), if the transport driving roller 51 rotates in that state, since a paper jam may occur, the procedure is finished. When it is determined that the remaining recording paper P is not present (No in step S8), the transport driving roller 51 rotates by a rotation amount corresponding to a rotation amount Nf1 at a rotation speed Sf1 (step S9).

On the other hand, when a power OFF operation of the ink jet printer 50 by a user is performed after recording is finished (Yes in step S2), it is determined whether or not a predetermined time has elapsed from a point of time when last recording control for the recording paper P was performed (step S11). When it is determined that the predetermined time has elapsed (Yes in step S11), the procedure is finished. However, when it is determined that the predetermined time has not elapsed (No in step S11), the same procedure as step S3 or S4 is performed (step S12 and S13).

At this time, when it is determined that the recording mode in which the latest recording control for the recording paper P is performed is a plain paper mode (No in step S12), the carriage 61 reciprocates by the number of times of operations Nc4 at an operation speed Sc4 (step S14). However, when it is determined that the recording mode is the dedicated paper mode (Yes in step S12), it is determined whether or not recording control is for brimless recording (step S13). When it is determined that the recording control is not brimless recording, the carriage 61 reciprocates by the number of times of operations Nc5 at an operation speed Sc5 (step S15). When it is determined that recording control is for brimless recording, the carriage 61 reciprocates by the number of times of operations Nc6 at an operation speed Sc6 (step S16).

After a reciprocation operation of the carriage 61 is performed (step S14, S15 or S16), the same procedures as steps S8 and S9 are performed (steps S17 and S18). At this time, when there is no remaining recording paper P (No in step S17), the transport driving roller 51 rotates by a rotation amount corresponding to a rotation amount Nf2 at a rotation speed Sf2 (step S18).

As described above, after recording control for the recording paper P is performed, control for rotating the paper transport belt 58 and the carriage belt 64 by a predetermined rotation amount Nc1 to Nc6, Nf1, or Nf2 at a predetermined rotation speed Sc1 to Sc6, Sf1, or Sf2 is performed. As a result, after recording control for the recording paper P is performed, static electricity can be charged to the ink absorbing material 59 of the paper transport belt 58 and the ink absorbing material 65 of the carriage belt 64 by a charging amount corresponding to the rotation speed and the rotation amount. That is, after recording control for the recording paper P is performed, a state in which the ink absorbing material 59 of the paper transport belt 58 and the ink absorbing material 65 of the carriage belt 64 can attract and absorb ink mists can be maintained for a longer time period. Even after recording control for the recording paper P is performed, ink mists which float in the inner space of the ink jet printer 50 can be effectively reduced.

The rotation speed and the rotation amount of the paper transport belt 58 and the carriage belt 64 may increase or decrease according to the recording mode through the procedure such as steps S3 to S7 and steps S12 to S16 described above. The recording mode as a "liquid ejecting control mode" will be further described. The recording mode of the ink jet printer 50 commonly includes the dedicated paper mode and the plain paper mode. When recording for the recording paper P is performed, either of recording modes can be selected depending on the type of the recording paper P.

The dedicated paper mode refers to a highly accurate mode for performing image recording on the recording paper P such as a photo paper, and in this mode, ink dots of a relatively small size are formed on the recording surface of the recording paper P at the high density to perform recording of the high image quality. The dedicated paper such as a photo paper has a coated recording surface and so has low absorbability. For this reason, in the dedicated paper mode, a relatively large amount of ink mists may be easily generated. Further, in the dedicated paper mode, the generation amount of ink mists depends on whether or not it is brimless recording. In the case of brimless recording, since recording is performed while dumping ink on the outside of the recording paper P, the generation amount of ink mists increases.

On the other hand, the plain paper mode refers to a mode for performing text recording on the recording paper P such as a plain paper, and in this mode, ink dots are formed on the recording surface of the recording paper P at a low density to perform recording at high speed. Since the recording surface of the plain paper is not coated, absorbability is high. Therefore, in the plain paper mode, the generation amount of ink mists is relatively small, or ink mists are hardly generated.

That is, the amount of ink mists generated when recording for the recording paper P is performed may be estimated from a recording control content such as the recording mode at the time of recording. For example, the amount of ink mists generated at the time of recording in the dedicated paper mode is larger than the amount of ink mists generated at the time of recording in the plain paper mode. Further, in the dedicated paper mode, the amount of ink mists generated at the time of brimless recording is relatively large. The amount of ink mists generated in each recording mode can be specified through an experiment for measuring a floating amount of ink mists immediately after recording in each recording mode.

Therefore, for example, the operation speeds Sc1 to Sc3 and the number of times of operations Nc1 to Nc3 of the carriage 61 may be set corresponding to the recording mode so that the ink absorbing material 65 of the carriage belt 64 can be charged by a charging amount corresponding to the amount of ink mists generated at the time of recording for the recording paper P. A correlation between the operation speed and the number of times of operations of the carriage 61 and the charging amount of the ink absorbing material 65 may be specified through, for example, an experiment for measuring a charging amount while sequentially changing the operation speed and the number of times of operations of the carriage 61. For example, the operation speed and the number of times of operations of the carriage 61 may be set as follows: Sc1=Sc2=Sc3 and Nc1 Nc2 Nc3 or Nc1=Nc2=Nc3 and Sc1 Sc2 Sc3. In detail, for example, the operation speed and the number of times of operations of the carriage 61 may be set such that the number of times of operations Nc1 to Nc3 is 10 times, that is, has a constant value, the operation speed Sc1=200 cps (1/10 inch per sec), the operation speed Sc2=300 cps, and the operation speed Sc3=400 cps.

However, in the case of the plain paper mode, a small amount of ink mists is generated, and the ink mists hardly have an influence. In this case, the number of times of operations Nc1 and Nc4 of the carriage 61 may be set to "0" not to rotate the carriage belt 64. Further, in the case of the plain paper mode, a step of passing rotation of the paper transport belt 58 may be added to the flowchart of FIG. 5. Since the generation amount of ink mists also depends on the size of the recording paper P, the operation speeds Sc1 to Sc6 and the number of times of operations Nc1 to Nc6 of the carriage 61 and the rotation speeds Sf1 and Sf2 and the rotation amounts Nf1 and Nf2 of the transport driving roller 51 may further increase or decrease depending on the size of the recording paper P.

As described above, since the operation speed and the number of times of operations of the reciprocation operation of the carriage 61 performed after recording for the recording paper P increases or decreases corresponding to the recording mode, the charging amount of the ink absorbing material 65 of the carriage belt 64 after recording can accurately increase or decrease according to the amount of ink mists generated at the time of recording for the recording paper P. That is, after recording for the recording paper P, the time of being capable of maintaining a state which can attract and collect ink mists through the ink absorbing material 65 of the carriage belt 64 can be accurately adjusted according to the amount of ink mists generated during recording. Therefore, ink mists which float in the inner space of the ink jet printer 50 can be effectively reduced even after recording for the recording paper P, and abrasion of the carriage belt 64 or power consumption caused by rotation of the carriage belt 64 after recording can be minimized.

When a power OFF operation of the ink jet printer 50 is detected, before performing predetermined power OFF control, rotation control of the paper transport belt 58 and the carriage belt 64 is preferably performed by the procedure such as steps S12 to S18 described above. As a result, even after the power of the ink jet printer 50 is turned off, since static electricity is continuously charged to the ink absorbing material 59 of the paper transport belt 58 and the ink absorbing material 65 of the carriage belt 64, a state which can attract and collect ink mists can be maintained for a predetermined time period even after the power of the ink jet printer 50 is turned off. Therefore, ink mists which float in the inner space of the ink jet printer 50 can be effectively reduced even after the power of the ink jet printer 50 is turned off.

Further, when a power OFF operation of the ink jet printer 50 is detected, control may be performed which rotates the paper transport belt 58 and the carriage belt 64 at a rotation amount more than a rotation amount or at a rotation speed higher than a rotation speed when control for rotating the paper transport belt 58 and the carriage belt 64 is performed after the latest recording control. Since the time of continuing an ink mist removal effect after power OFF of the ink jet printer 50 can be increased, ink mists which float in the inner space of the ink jet printer 50 can be further effectively reduced after the power of the ink jet printer 50 is turned off. Further, the floating amount of ink mists at the time of detecting a power OFF operation of the ink jet printer 50 can be estimated as accurately as possible based on the rotation amount or the rotation speed when the paper transport belt 58 and the carriage belt 64 rotate after the latest recording control. The time of continuing an ink mist removal effect after power of the ink jet printer 50 is off can be accurately set according to the floating amount of ink mists at that time.

For example, when the operation speeds Sc1 to Sc6 of the carriage 61 are set to a certain speed, the number of times of operations Nc4 to Nc6 of the carriage 61 is preferably set more than the number of times of operations Nc1 to Nc3 of the carriage 61 after recording for the recording paper P. For example, when the number of times of operations Nc1 to Nc6 of the carriage 61 is set to the certain number of times, the operation speeds Sc4 to Sc6 of the carriage 61 are preferably set to a rotation speed faster than the operation speeds Sc1 to Sc3 of the carriage 61 after recording for the recording paper P. The rotation speeds Sf1 and Sf2 and the rotation amounts Nf1 and Nf2 of the transport driving roller 51 may be set in the same manner.

Further, when a power OFF operation of the ink jet printer 50 is detected and a predetermined time elapses after the latest recording control for the recording paper P (Yes in step S11 of FIG. 5), in most cases, hardly any ink mists float in the inner space of the ink jet printer 50. In this case, control for rotating the paper transport belt 58 and the carriage belt 64 is not performed, and power OFF control of the ink jet printer 50 is preferably performed. As a result, unnecessary belt abrasion or power consumption can be avoided. A time of from the time of finishing the recording control until the inner space of the ink jet printer 50 becomes a state in which hardly any ink mists float therein may be measured through, for example, an experiment.

Other Embodiments

As a modification of the third embodiment, for example, either the ink absorbing material 59 of the paper transport belt 58 or the ink absorbing material 65 of the carriage belt 64 may be disposed. In this case, a control procedure may be a procedure in which the process related to the rotation control of the belt having no ink absorbing material is omitted from the flowchart of FIG. 5.

As another modification of the third embodiment, instead of the ink absorbing material of the paper transport belt 58 or the carriage belt 64, a belt cleaning unit for removing and collecting inks sticking to the belt may be installed. As the belt cleaning unit, for example, a member (for example, the ink removal member 591 in FIG. 4) for scraping ink sticking to the belt may be installed. Alternately, a driven roller with an outer peripheral surface on which an ink absorbing material is formed may be disposed at a location which comes in contact with an outer peripheral surface of the paper transport belt 58 or the carriage belt 64.

However, the invention is not limited to the embodiments described above, and it should be understood that various modifications can be made within the scope of the invention as defined in claims and included within the scope of the invention.

What is claimed is:

1. A liquid ejecting apparatus, comprising:

a liquid ejecting head which ejects a liquid onto a liquid ejection surface of an ejection target member;

a scanning unit which scans the liquid ejecting head relative to the ejection target member; and a driving force transmission mechanism which transmits driving force of a rotary driving force source to the scanning unit through a belt, wherein a liquid absorbing material which absorbs and retains mists of a liquid floating in an inner space of the liquid ejecting apparatus is disposed on the belt.

2. The liquid ejecting apparatus according to claim 1, further comprising a cleaning unit for the liquid absorbing material.

3. The liquid ejecting apparatus according to claim 1, further comprising a controller which performs control for ejecting a liquid onto a liquid ejection surface of the ejection target member, wherein the controller performs control for rotating the belt by a predetermined rotation amount after finishing liquid ejecting control for the ejection target member.

4. The liquid ejecting apparatus according to claim 3, wherein the controller increases or decreases the predetermined rotation amount based on a liquid ejecting control mode for the ejection target member.

5. The liquid ejecting apparatus according to claim 3, wherein the controller sets the rotation speed of the belt when control for rotating the belt by the predetermined rotation amount is performed based on a liquid ejecting control mode for the ejection target member.

6. The liquid ejecting apparatus according to claim 3, wherein when a power OFF operation of the liquid ejecting apparatus is detected, the controller performs power OFF control of the liquid ejecting apparatus after finishing control for rotating the belt by the predetermined rotation amount.

7. The liquid ejecting apparatus according to claim 6, wherein when a power OFF operation of the liquid ejecting apparatus is detected, the controller performs control for rotating the belt at a rotation amount more than a rotation amount or at a rotation speed higher than a rotation speed when control for rotating the belt is performed after the latest liquid ejecting control for an ejection target member is finished.

8. The liquid ejecting apparatus according to claim 6, wherein when a power OFF operation of the liquid ejecting apparatus is detected, if a predetermined time elapses after the latest liquid ejecting control for an ejection target member is finished, the controller does not perform control for rotating the belt and performs power OFF control of the liquid ejecting apparatus.

* * * * *